US008851104B2

(12) United States Patent
One

(10) Patent No.: US 8,851,104 B2
(45) Date of Patent: Oct. 7, 2014

(54) ELEVATING FIRE HYDRANT ASSEMBLY

(76) Inventor: Syeng Yen One, Suwon-si (KR)

( * ) Notice: Subject to any disclaimer, the term of this patent is extended or adjusted under 35 U.S.C. 154(b) by 0 days.

(21) Appl. No.: 13/265,852

(22) PCT Filed: Apr. 20, 2010

(86) PCT No.: PCT/KR2010/002466

§ 371 (c)(1),
(2), (4) Date: Oct. 21, 2011

(87) PCT Pub. No.: WO2010/123255

PCT Pub. Date: Oct. 28, 2010

(65) Prior Publication Data

US 2012/0031507 A1 Feb. 9, 2012

(30) Foreign Application Priority Data

Apr. 21, 2009 (KR) ..... 10-2009-0034718

(51) Int. Cl.
*E03B 9/02* (2006.01)
*A62C 35/20* (2006.01)
*E03B 9/08* (2006.01)

(52) U.S. Cl.
CPC .. *A62C 35/20* (2013.01); *E03B 9/08* (2013.01)
USPC ..... 137/301; 137/294; 137/300

(58) Field of Classification Search
CPC ..... E03B 9/02; E03B 9/04; E03B 9/027; E03B 9/12
USPC ..... 137/301, 292, 293–295, 272, 300
See application file for complete search history.

(56) References Cited

U.S. PATENT DOCUMENTS 7,228,868 B2 * 6/2007 Kang ..... 137/301

FOREIGN PATENT DOCUMENTS

| | | |
|---|---|---|
| JP | 07-21065 | 4/1995 |
| JP | 07-113254 | 5/1995 |
| JP | 2006-518816 | 8/2006 |
| KR | 10-1999-0046581 | 7/1999 |
| KR | 20-0385180 | 5/2005 |
| KR | 10-0518985 | 10/2005 |
| KR | 10-2006-0053083 | 5/2006 |

OTHER PUBLICATIONS

International Search Report for PCT/KR2010/002466 mailed Jan. 28, 2011.

* cited by examiner

*Primary Examiner* — Kevin Lee
(74) *Attorney, Agent, or Firm* — Revolution IP, PLLC

(57) ABSTRACT

Disclosed is an elevating fire hydrant assembly. The elevating fire hydrant assembly includes: a water pipe which supplies firefighting water in accordance with the open or shut operation of a water control valve buried underground; an elbow pipe connected to the water pipe; a fixing pipe connected to the elbow pipe; an elevating pipe which is coupled to the fixing pipe to retract into or extend from the ground, and the lower end of which is coupled to a guide block that slides along the inner surface of the fixing pipe; a sealing plate coupled to the top of the fixing pipe to prevent the elevating pipe from escaping; a head block which is coupled to the top of the elevating pipe, and which has a hose connector for connecting a firefighting hose; and valve means for opening or shutting the lower end of the elevating pipe.

6 Claims, 6 Drawing Sheets

*-Prior Art-*

*-Prior Art-*

ELEVATING FIRE HYDRANT ASSEMBLY

RELATED APPLICATIONS

This application is a 371 application of International Application No. PCT/KR2010/002466, filed Apr. 20, 2010, which in turn claims priority from Korean Patent Application No. 10-2009-0034718, filed Apr. 21, 2009, each of which is incorporated herein by reference in its entirety.

TECHNICAL FIELD

The present invention relates to an elevating fire hydrant assembly, more specifically, an elevating fire hydrant assembly where an elevating pipe is automatically projected from the ground by water pressure at the time of using of the fire hydrant and a lowering speed of the elevating pipe projected from the ground can be adjusted after using of the fire hydrant.

BACKGROUND ART

A fire hydrant always projected from the ground has a problem that it is susceptible to freeze and burst in a very cold weather as well as is an obstacle to passage and susceptible to break resulting from external force, and therefore elevating fire hydrant has been recently developed.

An example of the elevating fire hydrant is disclosed in Korean U.M. Registration No. 20-0316237 and shown in FIGS. 1 and 2.

The disclosed elevating fire hydrant has a structure that a water supply pipe (10), a valve pipe (112) and a barrel pipe (122) are connected to one another, and a discharge pipe (142) is coupled inside the barrel pipe (122) so as to be rotatable with a power of a handle (148) by a worker and a valve body (190) is provided which opens and closes the valve pipe (112) by means of a rotation of a rotatable body (172).

Such a fire hydrant has a structure that, if the worker pulls the handle (148) upwards grasping, it the discharge pipe (142) is withdrawn from the barrel pipe (122) to rise upward, thereafter a firefighting hose is connected to a discharge port (160), and the valve body (190) is then opened by rotating the rotatable body (172), whereby firefighting water is discharged.

However, the fire hydrant of such a structure has a troublesomeness that for using the fire hydrant the worker has to project the discharge pipe (142) from the ground grasping the handle (148).

Furthermore, after the fire hydrant has been used, the discharge pipe (142) has to be coupled with the barrel pipe (122) by applying a downward force to the handle (148) grasping it; in this case, since the firefighting water is filled within the discharge pipe (142), barrel pipe (122) and valve pipe (112), a lowering operation is difficult and very slowly carried out, thus operation speed is slow.

DISCLOSURE OF THE INVENTION

The present invention has been devised to solve the above-mentioned problems, and its object is to provide an elevating fire hydrant assembly where an elevating pipe is automatically projected from the ground by water pressure at the time of using of the fire hydrant.

Another object is to provide an elevating fire hydrant assembly where lowering speed of the elevating pipe projected from the ground can be adjusted after using of the fire hydrant.

In order to achieve the object, the elevating fire hydrant assembly of the present invention comprises a water pipe which supplies firefighting water in accordance with opening and closing of a water control valve buried underground; an elbow pipe connected to the water pipe; a fixed pipe connected to the elbow pipe; an elevating pipe which is coupled to the fixed pipe to retract into or extend from the ground and a lower end part of which is coupled to a guide block that slides along the inner surface of the fixed pipe; a sealing plate coupled to the top of the fixed pipe to prevent the elevating pipe from escaping; a head block which is coupled to the top of the elevating pipe and has a hose connector for connecting a firefighting hose; and a valve means for opening and closing the lower end part of the elevating pipe, wherein in the state of the lower end part of the elevating pipe being closed by the valve means, the elevating pipe is risen by pressure of the firefighting water supplied through the water pipe.

Furthermore, the elevating fire hydrant assembly of the present invention further comprises an air valve that is opened/closed so as to discharge air between the fixed pipe and the elevating pipe or introduce air into between them.

Furthermore, the elevating fire hydrant assembly of the present invention further comprises a check valve which is connected to the elbow pipe and closed at the time of opening of the water control valve, and opened at the time of closing of the water control valve to outwardly discharge the firefighting water remaining in the elevating pipe and elbow pipe.

Furthermore, the valve means comprises a valve body which can be in close contact with the lower end part of the elevating pipe or released therefrom; an operating rod, a lower end part of which is coupled to the valve body and an upper end part of which is rotatably supported by the head block so that the rod can be risen and lowered; and a handle which is coupled to the upper end part of the operating rod to rotate the operating rod.

The present invention has advantageous effects as follows:

First, since the elevating pipe (40) is risen to be projected from ground by high pressure of the firefighting water when the water control valve is opened, a quick operation is enabled in an emergency situation, contrary to a prior art where the elevating pipe is manually projected from the ground by a worker.

Second, a space between the fixed pipe and the elevating pipe is opened and closed by the air valve, a rising speed and a lowering speed of the elevating pipe (40) can be controlled, accordingly the elevating pipe can be prevented from being risen abruptly and thus safety accident can be avoided, and the elevating pipe can be smoothly lowered.

Third, since the handle (62) for opening and closing the valve body (60) is installed on the head block (50), an inconvenience can be eliminated that the valve body is conventionally opened and closed by a separate wrench.

DETAILED DESCRIPTION OF THE INVENTION

A elevating fire hydrant assembly according to an example of the present invention avoids an operational troublesomeness that the worker has to manually project an elevating pipe from the ground in the prior art, and allows the worker to lower the elevating pipe with less force.

Figure 1:
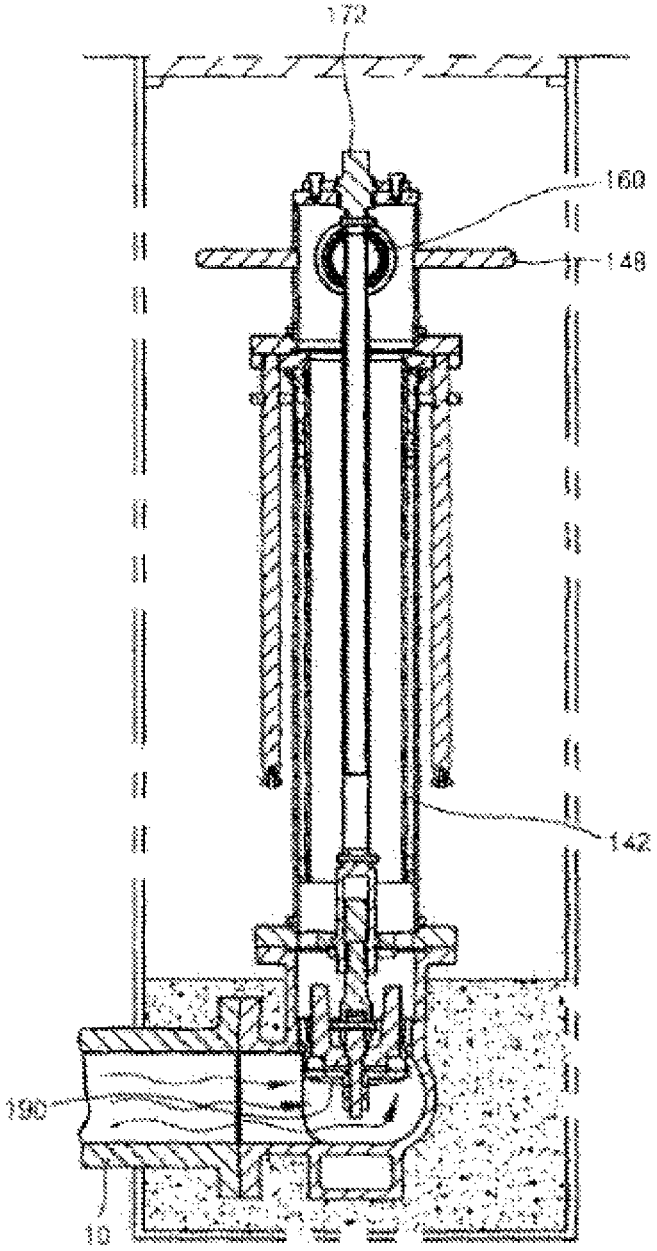
FIG. 1 and FIG. 2 are schematic views showing operation states of a conventional fire hydrant.
Figure 2:
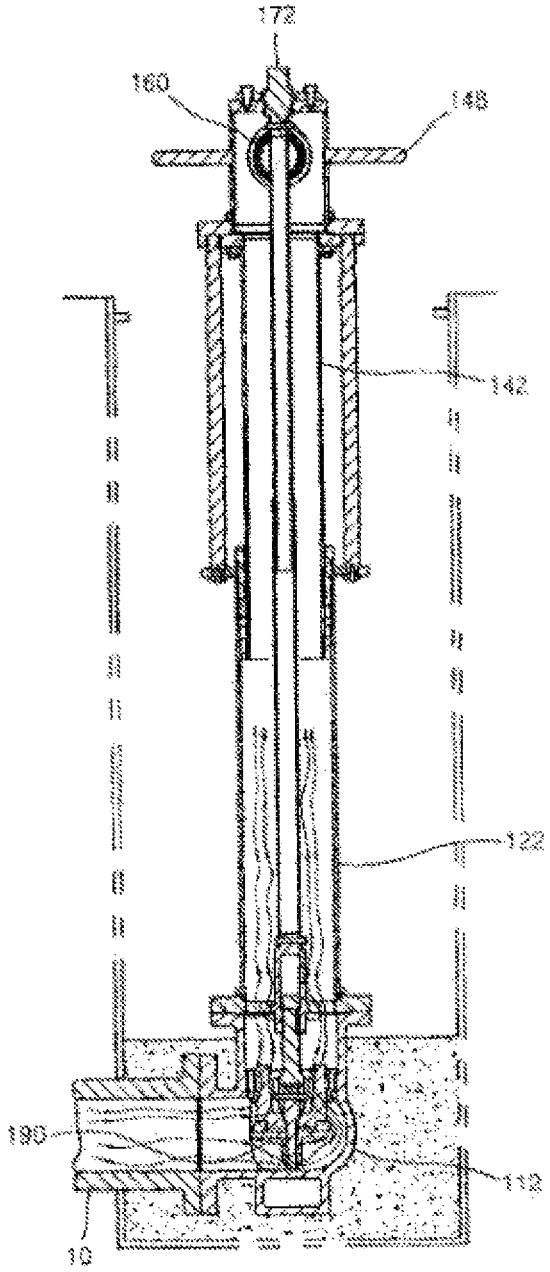
Figure 3:
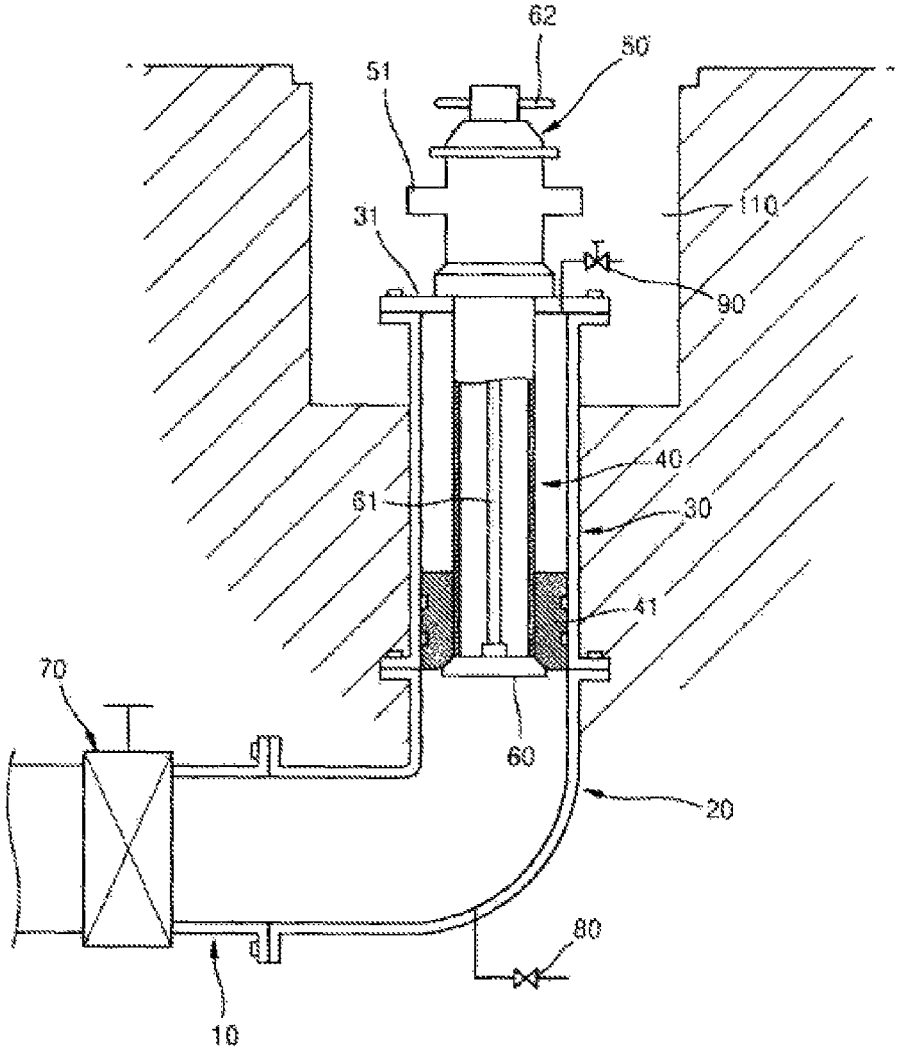
FIGS. 3 to 5 are schematic views showing operation states of a fire hydrant according to an example of the present invention.
Figure 4:
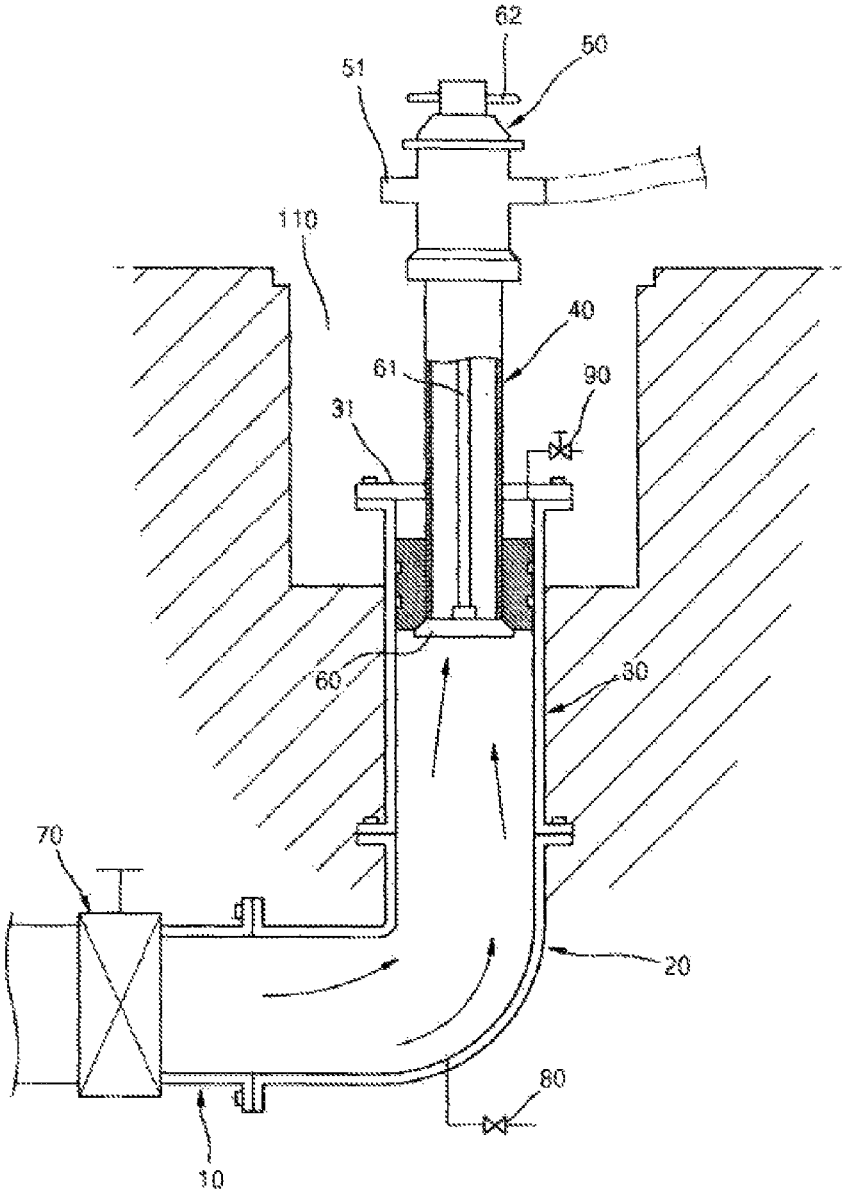
Figure 5:
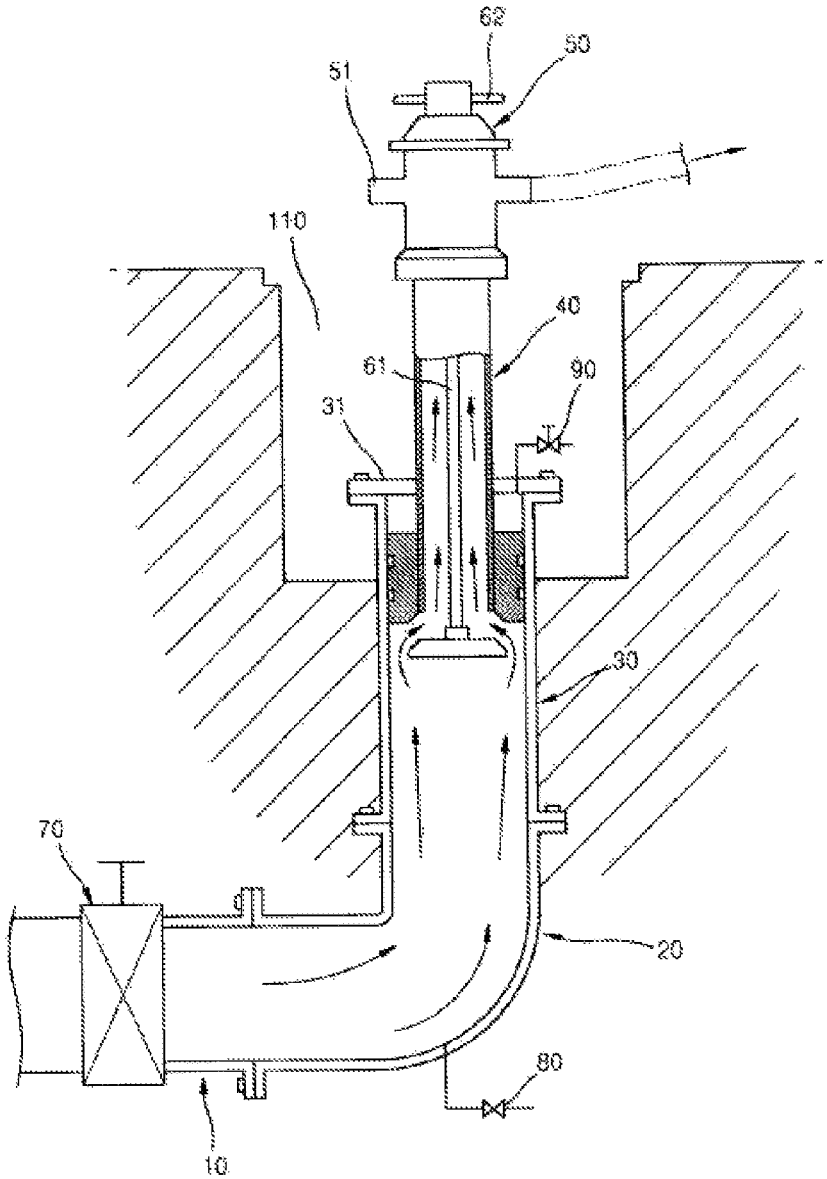

Referring to FIGS. 3 to 5 showing the fire hydrant assembly according to an example of the present invention, it comprises a water pipe (10) which supplies firefighting water in accordance with opening and closing of a water control valve (70) buried underground; a right angle elbow pipe (20) connected to the water pipe (10); a fixed pipe (30) connected to the elbow pipe (20); an elevating pipe (40) which is coupled to the fixed pipe (30) to retract into or extend from the ground and the lower end part of which is coupled to a guide block (41) that slides along the inner surface of the fixed pipe (30); a sealing plate (31) coupled to the top of the fixed pipe (30) to prevent the elevating pipe (40) from escaping; a head block (50) which is coupled to the top of the elevating pipe (40) and which has a hose connector (51) for connecting a firefighting hose (100); and a valve means for opening and closing the lower end part of the elevating pipe.

The valve means comprises a valve body (60) which can be in close contact with the lower end part of the elevating pipe (40) or released therefrom; an operating rod (61), a lower end part of which is coupled to the valve body (60) and an upper end part of which is rotatably supported by the head block (50) so that the rod can be risen and lowered; and a handle (62) which is coupled to the upper end part of the operating rod (61) to rotate the operating rod (61).

The water control valve (70) is connected to the ground and can be opened and closed by means of a separate opening/closing means (not shown). The water pipe (10), elbow pipe (20) and a part of the fixed pipe (30) are buried underground, and upper end part of the fixed pipe (30) is projected into fire hydrant pit (110) in the ground.

The sealing plate (31) is provided with an air valve (90) which is opened/closed to discharge air between the fixed pipe (30) and the elevating pipe (40) or introduce air into between them.

Furthermore, there is provided a check valve (80) which is connected to the elbow pipe (20) and closed at the time of opening of the water control valve (70), and opened at the time of closing of the water control valve (70) to outwardly discharge the firefighting water remaining in the elevating pipe (40) and elbow pipe (20).

As shown in FIG. 6, the check valve (80) is formed with an inlet opening (81) connected with the elbow pipe (20) and a water exit (82) through which the firefighting water is discharged. Installed within the check valve is a movable spool (83), head part of which is formed with a cutout groove (83*a*) allowing passage of the firefighting water, and tail part of which can open and close the water exit (82), and a spring (84) is provided in the check valve, which spring biases the movable spool (83) toward a direction of opening of the water exit (82).

In the following, operation of the fire hydrant assembly having the construction as stated above will be described.

Referring to FIG. 3, for using the fire hydrant, a cover (not shown) covering the fire hydrant pit (110) is opened and then the water control valve (70) is opened. As shown in FIG. 4, the valve body (60) and the elevating pipe (40) are risen relative to the fixed pipe (30) by water pressure of the firefighting water supplied at this time, whereby the head block (50) is projected from the ground.

At this time, a rising speed of the elevating pipe (40) risen by the water pressure can be adjusted by adjusting a degree of opening of the air valve (90). Namely, the rising speed of the elevating pipe (40) can be adjusted by adjusting a discharge rate of the air remaining in a space between the fixed pipe (30) and the elevating pipe (40). Therefore, safety accident can be avoided by preventing the elevating pipe (40) from being risen abruptly by the firefighting water of a high pressure.

In such a state, a firefighting hose (100) is connected to the hose connector (51), and thereafter, as shown in FIG. 5, the valve body (60) is lowered with the operating rod (61) by rotating the handle (62), whereby the lower end part of the elevating pipe (40) is opened and thus the firefighting water is discharged through the firefighting hose (100).

Figure 6A:
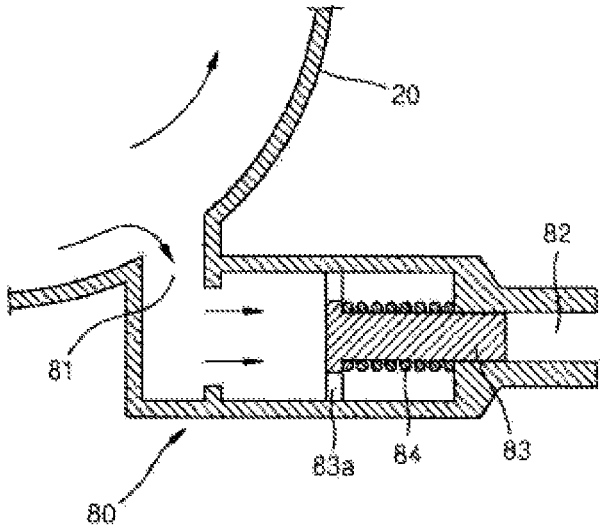
FIGS. 6*a* and 6*b* are operation states of a check valve used in the fire hydrant according to an example of the present invention.

Meanwhile, the check valve (80) is closed while the firefighting water is discharged. Namely, as shown in FIG. 6*a*, if the firefighting water of a high pressure flows into the check valve through the inlet opening (81), the movable spool (83) is moved while compressing the spring (84) to close the water exit (82), thereby interrupting drain of the firefighting water.

After the fire hydrant has been used, the water control valve (70) is closed, and the elevating pipe (40) is then retracted into the fixed pipe (30) by downwardly pressing the head block (50). At this time, outside air is introduced between the fixed pipe (30) and the elevating pipe (40) by opening the air valve (90), whereby the elevating pipe (40) can be smoothly lowered.

If the elevating pipe (40) is completely lowered and the firefighting water remaining within the elevating pipe (40) is completely drained through the check valve (80) after elapse of a certain time, the lower end part of the elevating pipe (40) is closed with the valve body (60) by rotating the handle (62).

Figure 6B:
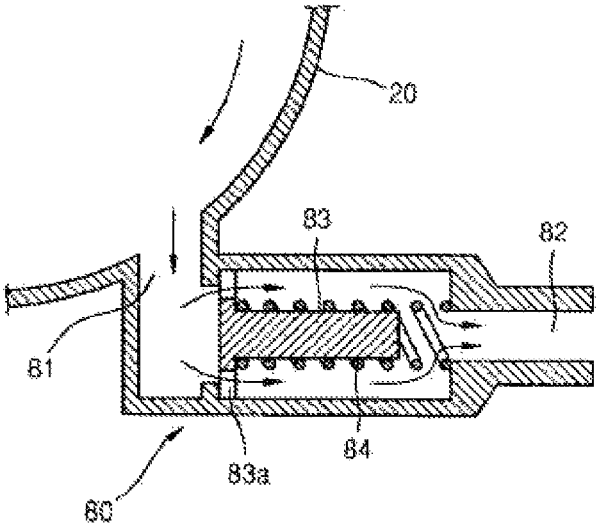

Furthermore, if the water control valve (70) is closed, the check valve (80) is opened, whereby the firefighting water remaining in the elevating valve (40) and the elbow pipe (20) is drained. Namely, as shown in FIG. 6*b*, since high pressure of the firefighting water is released, the movable spool (83) is moved by a restoring force of the spring (84) to open the water exit (82). At this time, the firefighting water introduced through the inlet opening (81) is drained to the water exit (82) via the cutout groove (83*a*).

When the fire hydrant is used, the elevating pipe can be automatically projected from the ground by the water pressure, and after the fire hydrant has been used, the lowering speed of the elevating pipe projected from the ground can be adjusted.

What is claimed:

1. An elevating fire hydrant assembly comprising:

a water pipe which supplies firefighting water in accordance with opening and closing of a water control valve buried underground;

an elbow pipe connected to the water pipe;

a fixed pipe connected to the elbow pipe;

an elevating pipe which is coupled to the fixed pipe to retract into or extend from the ground and a lower end part of which is coupled to a guide block that slides along an inner surface of the fixed pipe;

a sealing plate coupled to the top of the fixed pipe to prevent the elevating pipe from escaping;

an air valve disposed above the fixed pipe and including a venting passage through the sealing plate;

a head block which is coupled to the top of the elevating pipe and has a hose connector for connecting a firefighting hose; and a valve means for opening and closing the lower end part of the elevating pipe, wherein, in the state of the lower end part of the elevating pipe being closed by the valve means, the elevating pipe is risen by pressure of the firefighting water supplied through the water pipe.

2. The elevating fire hydrant assembly according to claim 1, wherein the an air valve is opened/closed so as to discharge air between the fixed pipe and the elevating pipe or introduce air into between them.

3. The elevating fire hydrant assembly according to claim 1, further comprising a check valve which is connected to the elbow pipe and closed at the time of opening of the water control valve, and opened at the time of closing of the water control valve to outwardly discharge the firefighting water remaining in the elevating pipe and elbow pipe.

4. The elevating fire hydrant assembly according to claim 3, wherein the valve means comprises a valve body which can be in close contact with the lower end part of the elevating pipe or released therefrom; an operating rod, a lower end part of which is coupled to the valve body and an upper end part of which is rotatably supported by the head block so that the rod can be risen and lowered; and a handle which is coupled to the upper end part of the operating rod to rotate the operating rod.

5. The elevating fire hydrant assembly according to claim 2, further comprising a check valve which is connected to the elbow pipe and closed at the time of opening of the water control valve, and opened at the time of closing of the water control valve to outwardly discharge the firefighting water remaining in the elevating pipe and elbow pipe.

6. The elevating fire hydrant assembly according to claim 5, wherein the valve means comprises a valve body which can be in close contact with the lower end part of the elevating pipe or released therefrom; an operating rod, a lower end part of which is coupled to the valve body and an upper end part of which is rotatably supported by the head block so that the rod can be risen and lowered; and a handle which is coupled to the upper end part of the operating rod to rotate the operating rod.

* * * * *